US006183885B1

(12) United States Patent
Nakamura et al.

(10) Patent No.: US 6,183,885 B1
(45) Date of Patent: Feb. 6, 2001

(54) FITTING-TYPE CONNECTION TERMINAL

(75) Inventors: Atsushi Nakamura, Yokkaichi; Jun Shioya; Atsuhiko Fujii, both of Nagoya; Nobuaki Isono, Shimonoseki; Yasuhiro Shintani, Shimonoseki; Masahiro Kawaguchi, Shimonoseki, all of (JP)

(73) Assignees: Harness System Technologies Research, Ltd., Nagoya; Sumitomo Wiring Systems, Ltd., Mie; Sumitomo Electric Industries, Ltd., Osaka; Kabushiki Kaisha Kobe Seiko Sho, Kobe, all of (JP)

( * ) Notice: Under 35 U.S.C. 154(b), the term of this patent shall be extended for 0 days.

(21) Appl. No.: 09/061,179

(22) Filed: Apr. 17, 1998

(30) Foreign Application Priority Data

Apr. 28, 1997 (JP) ..... 9-110895

(51) Int. Cl.[7] ..... H01R 13/03

(52) U.S. Cl. ..... 428/647; 428/648; 428/929; 439/886

(58) Field of Search ..... 428/646, 647, 428/648, 680, 929; 439/886

(56) References Cited

U.S. PATENT DOCUMENTS

| | | | | |
|---|---|---|---|---|
| 3,718,750 | * | 2/1973 | Sayers | 174/94 R |
| 4,723,923 | | 2/1988 | Senor et al. | 439/853 |
| 5,028,492 | * | 7/1991 | Guenin | 428/614 |
| 5,141,702 | * | 8/1992 | Guenin et al. | 419/8 |
| 5,235,743 | * | 8/1993 | Endo et al. | 29/685 |
| 5,272,295 | | 12/1993 | Sawada et al. | 200/267 |
| 5,322,575 | | 6/1994 | Endo et al. | 148/554 |
| 5,391,097 | * | 2/1995 | Kerul | 439/825 |
| 5,634,829 | * | 6/1997 | Kerul | 439/851 |
| 5,853,557 | * | 12/1998 | Souza et al. | 205/109 |

FOREIGN PATENT DOCUMENTS

| | | | |
|---|---|---|---|
| 2-17637 | | 4/1990 | (JP) . |
| 5-258633 | | 10/1993 | (JP) . |
| 7-249445 | | 9/1995 | (JP) . |
| 8-7960 | | 1/1996 | (JP) . |
| 10-46363 | * | 2/1998 | (JP) . |
| 10-265992 | * | 10/1998 | (JP) . |
| WO 91/13754 | | 9/1991 | (WO) . |
| WO 97/22472 | | 6/1997 | (WO) . |

* cited by examiner

*Primary Examiner*—John Zimmermann
(74) *Attorney, Agent, or Firm*—Oliff & Berridge, PLC

(57) ABSTRACT

There is disclosed a fitting-type connection terminal in which an insertion force for a terminal can be reduced while maintaining a stable contact resistance. If the thickness of a tin film on one of male and female terminals is 0.1 μm to 0.3 μm while the thickness of a tin film on the other terminal is not less than 0.1 μm, the hardness of the terminal is increasingly influenced by the hardness of a base material (of copper or copper alloy) with the decrease of the thickness of the tin film, so that the apparent hardness of the terminal increases. As a result, the adhesion of the tin film is suppressed, and the terminal insertion force can be reduced at least by more than 10% as compared with a reference value (1.0 μm for each of the male and female terminals). Particularly if the thickness of the tin film on the male terminal 10 is 0.1 μm while the thickness of the tin film on the female terminal 20 is 0.3 μm to 1.0 μm, the insertion force can be reduced by more than 30%.

8 Claims, 4 Drawing Sheets

FITTING-TYPE CONNECTION TERMINAL

BACKGROUND OF THE INVENTION

1. Field of the Invention

This invention relates to a fitting-type connection terminal used in electric wiring in an automobile, an industrial equipment and so on.

2. Related Art

Generally, in electric wiring used in an automobile, an industrial equipment and so on, tinning has heretofore been applied to a fitting-type connection terminal used for connecting wires together. The purpose of this is that when connecting the terminals together, an oxide film on the surface of the tin film is destroyed by friction, thereby causing fresh tin to adhere to the terminal, so that a low contact resistance can be stably obtained.

In electric wiring used in a particularly-important signal circuit, for example, for an ABS (anti-lock braking system) and an air bag, connection terminals have been plated with gold.

The above adhesion of the tin film is due to the low hardness of tin (Vickers hardness of 40 to 80). However, the low hardness of tin invites a problem that an increased insertion force is required when connecting the terminals together. Namely, during the fitting connection of the terminal, the tin film is worn by adhesion, and the terminal is fitted against the deformation resistance of tin, so that the insertion force is increased.

Incidentally, in electric wiring in an automobile and so on, it is a common practice to connect a bundle of wires (hereinafter referred to as "wire harness") by the use of only one connector, and the force required for connecting the connector can be estimated by multiplying an insertion force, required for one terminal, by the number of wires (conventionally, 10 to 20 poles). Therefore, if the insertion force per terminal is high, the force required for the connection of the connector becomes a large value corresponding to the number of wires of the wire harness.

Particularly, recently, with the marked advance and development of car electronics, the number of electronic devices and CPUs, mounted on an automobile, has greatly increased, and therefore the number of wires of the wire harness has increased, and it has been eagerly desired to achieve a multi-pole design of a connector (e.g., 30 to 40 poles).

However, as described above, in the case of the multi-pole design of the connector, the force required for the connection of the connector increases in proportion to the number of the wires, and the connection of the connector can not be effected without the use of an auxiliary mechanism such as a bolt and a lever. Therefore, even if the terminal is formed into a small size, the auxiliary mechanism prevents the compact, lightweight design of the connector.

One proposal to reduce the insertion force for the terminal is to reduce a contact pressure (i.e., pressing force applied to a contact point at a fitting portion). In this case, however, a stable, low contact resistance can not be obtained. In other words, it is difficult to reduce the terminal insertion force while maintaining the stable contact resistance, and therefore the auxiliary mechanism becomes indispensable when forming the connector into a multi-pole design, and this prevents the compact, lightweight design of the connector.

When gold is plated on the connection terminals, the low contact resistance can be obtained even with the low contact pressure, and therefore the terminal insertion force can be reduced, and the force, required for the connection of the connector, is not much increased. However, the cost of the gold plating is several times to several tens of times higher than the cost of the tinning, and therefore this is not suitable particularly for the multi-pole connector.

SUMMARY OF THE INVENTION

With the above problems in view, it is an object of this invention to provide a fitting-type connection terminal in which an insertion force for a terminal can be reduced while maintaining a stable contact resistance.

In order to solve the above problems, according to the invention of a first aspect of the invention, there is provided a fitting-type connection terminal for achieving electrical contact by fitting a male member and a female member together;

wherein a tin film, having a thickness of 0.1 μm to 0.3 μm, is formed by plating on sliding-contact portions of a base material of one of the male and female members while a tin film, having a thickness of not less than 0.1 μm, is formed by plating on sliding-contact portions of a base material of the other member, the sliding-contact portions of the base material of the one member being in sliding contact with the sliding-contact portions of the base material of the other member during the fitting operation.

In the fitting-type connection terminal according to a second aspect of the invention, the tin film, having a thickness of 0.1 μm to 0.3 μm (preferably 0.1 μm) is formed on one of the male and female members whose sliding-contact portions are larger in area than the sliding-contact portions of the other member, while the tin film, having a thickness of 0.3 μm to 1.0 μm, is formed on the other member having the sliding-contact portions of a smaller area.

In the fitting-type connection terminal according to a third aspect of the invention, a diffusion barrier layer is interposed between the base material and the tin film in each of the male and female members.

In the fitting-type connection terminal according to a fourth aspect of the invention, the diffusion barrier layer is a nickel film formed by plating.

DESCRIPTION OF THE PREFERRED EMBODIMENT OF THE INVENTION

A preferred embodiment of the present invention will now be described in detail with reference to the drawings.

A: Embodiment of Fitting-type Connection Terminal

Figure 1:
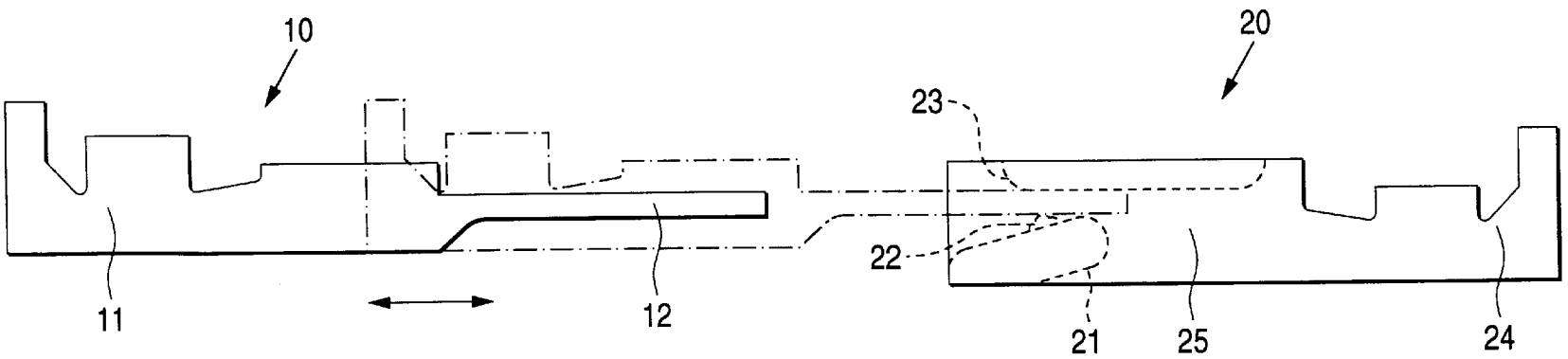
FIG. 1 is a side view of a fitting-type connection terminal of the present invention.
Figure 2:
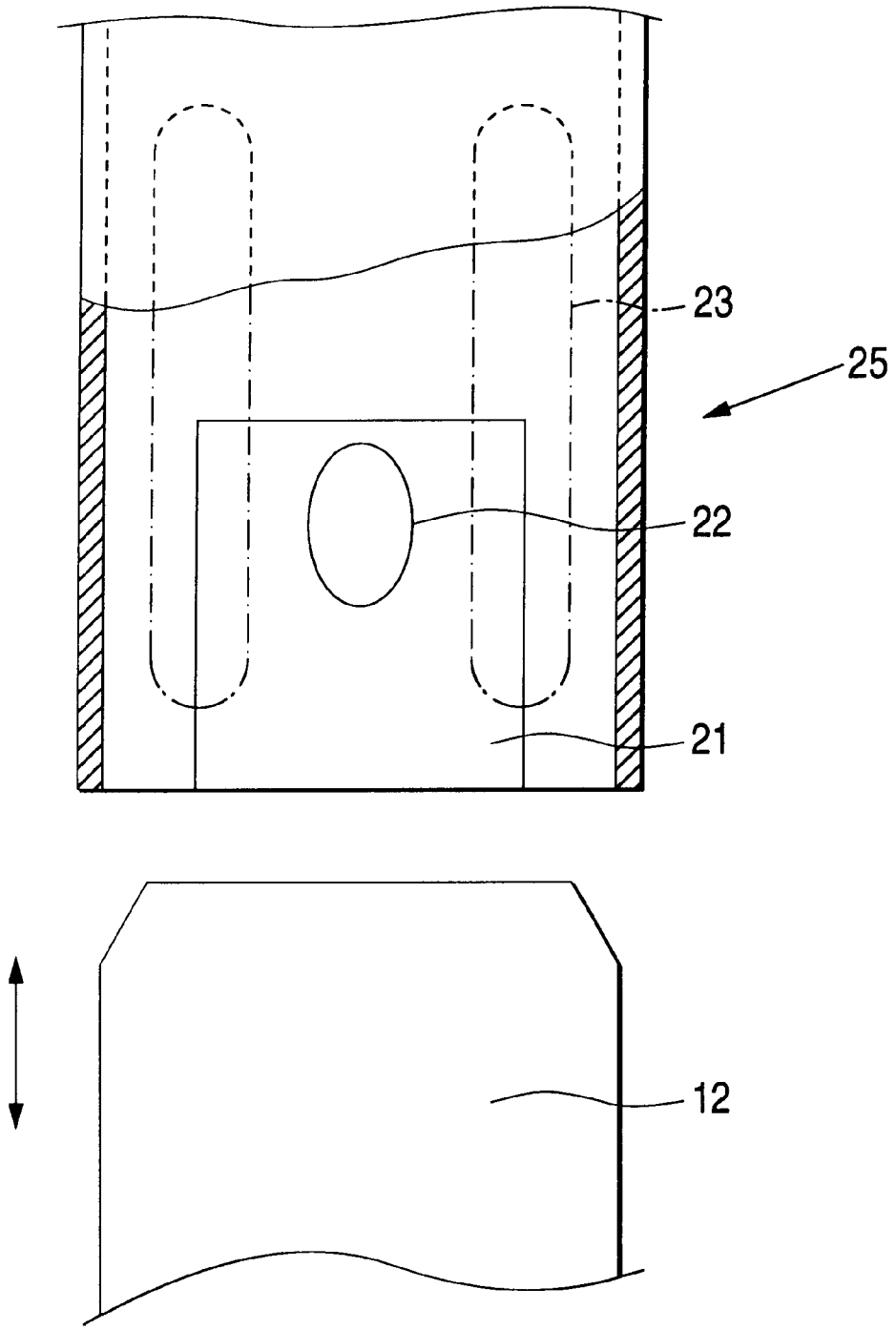
FIG. 2 is a plan view showing a connection portion of the fitting-type connection terminal of FIG. 1.

FIG. 1 is a side view of a fitting-type connection terminal of the present invention, and FIG. 2 is a plan view showing a connection portion of this fitting-type connection terminal.

As shown in the drawings, the fitting-type connection terminal of the invention comprises a male terminal 10 and a female terminal 20. The male terminal 10 includes a wire barrel 11 serving as a clamping portion for clamping a wire, and a tab 12 serving as a fitting portion for fitting in the female terminal 20. Each of upper and lower surfaces of the tab 12 is formed into a flat, smooth sliding surface.

The female terminal 20 includes a wire barrel 24 serving as a clamping portion for clamping a wire, and a fitting portion 25 for fitting on the male terminal 10. The fitting portion 25 has a hollow, box-shaped construction, and a tongue 21, an embossed portion 22 and beads 23 are provided within the fitting portion 25. FIG. 2 is a plan view showing the interior of the fitting portion 25.

The embossed portion 22 is a convex portion formed on the upper side of the tongue 21, and is brought into point-contact with the sliding surface of the tab 12 when the female terminal 20 is fitted on the male terminal 10. The tongue 21 functions as a spring for applying a pressure (that is, contact pressure) to press the embossed portion 22 against the tab 12. Each of the beads 23 is a convex portion, and the beads 23 contact that sliding surface of the tab 12 facing away from the embossed portion 22, and receive the contact pressure applied to the tab 12 by the embossed portion 22.

For fitting the male terminal 10 into the female terminal 20, the tab 12 is inserted into a gap between the embossed portion 22 and the beads 23. At this time, one of the upper and lower surfaces of the tab 12 is in sliding contact with the embossed portion 22 whereas the other surface is in sliding contact with the beads 23. The embossed portion 22 is held in point-contact with the tab 12, and therefore the sliding-contact portion of the embossed portion 22 is a point, and the sliding-contact portion of the tab 12 is a line. A portion of contact of each bead 23 with the tab 12 is a sliding-contact portion. Namely, the area of the sliding-contact portions of the female terminal 20 during the fitting operation is the sum of the area of sliding contact of the embossed portion 22 with the tab 12 and the areas of sliding contact of the beads 23 with the tab 12. The area of the sliding-contact portions of the male terminal 10 (when the tab 12 is held in sliding contact with the embossed portion 22 and the beads 23) is an area corresponding to a distance over which the male terminal 10 moves relative to the female terminal 20. Therefore, in this embodiment, the area of the sliding-contact portions of the male terminal 10 is larger than the area of the sliding-contact portions of the female terminal 20.

B: Tinning on Fitting-type Connection Terminal

The male terminal 10 and the female terminal 20 comprise a base material of copper or copper alloy. Since copper and copper alloy have a high hardness (Vickers hardness of not less than 100), a resistance of contact between the male and female terminals 10 and 20 is sometimes high. Therefore, tinning is applied at least to the contact portions of the two terminals, that is, the tab 12, the embossed portion 22 and the beads 23. Tinning achieves the effect of reducing the contact resistance as described above. In this embodiment, nickel is first plated on the surface of the base material made of copper or copper alloy, and then tin is plated on this nickel film. The reason for this will be described later.

Tin was plated on a conventional terminal to form a tin film having a thickness of not less than 1.0 $\mu$m. The reasons for this is that the cost of the tinning is relatively low, and that the corrosion resistance of the terminal is taken into consideration.

In the fitting-type connection terminal of the present invention, tinning is preferably effected to form a thin tin film having a thickness of not more than 1.0 $\mu$m, so that the apparent hardness of the contact portions of the terminal is increased, thereby reducing the insertion force. This will now be explained with reference to test results shown below.

In the test, the thickness of the tin film on the male terminal 10 and the female terminal 20 was varied in the range of from 0.1 $\mu$m to 1.0 $\mu$m, and the insertion force, required when fitting the male and female terminals 10 and 20 together, was measured. Table 1 below show the test results.

TABLE 1

Terminal insertion force (kgf)

| | | Thickness of Tin Film on Male Terminal ($\mu$m) | | | | |
|---|---|---|---|---|---|---|
| | | 0.1 | 0.3 | 0.5 | 0.7 | 1.0 |
| Thickness of Tin Film on Female Terminal ($\mu$m) | 0.1 | 0.58 | 0.56 | 0.54 | 0.56 | 0.55 |
| | 0.3 | 0.50 | 0.58 | 0.61 | 0.61 | 0.64 |
| | 0.5 | 0.48 | 0.62 | 0.63 | 0.67 | 0.72 |
| | 0.7 | 0.47 | 0.64 | 0.66 | 0.69 | 0.71 |
| | 1.0 | 0.46 | 0.65 | 0.69 | 0.70 | 0.74 |

Figure 3:
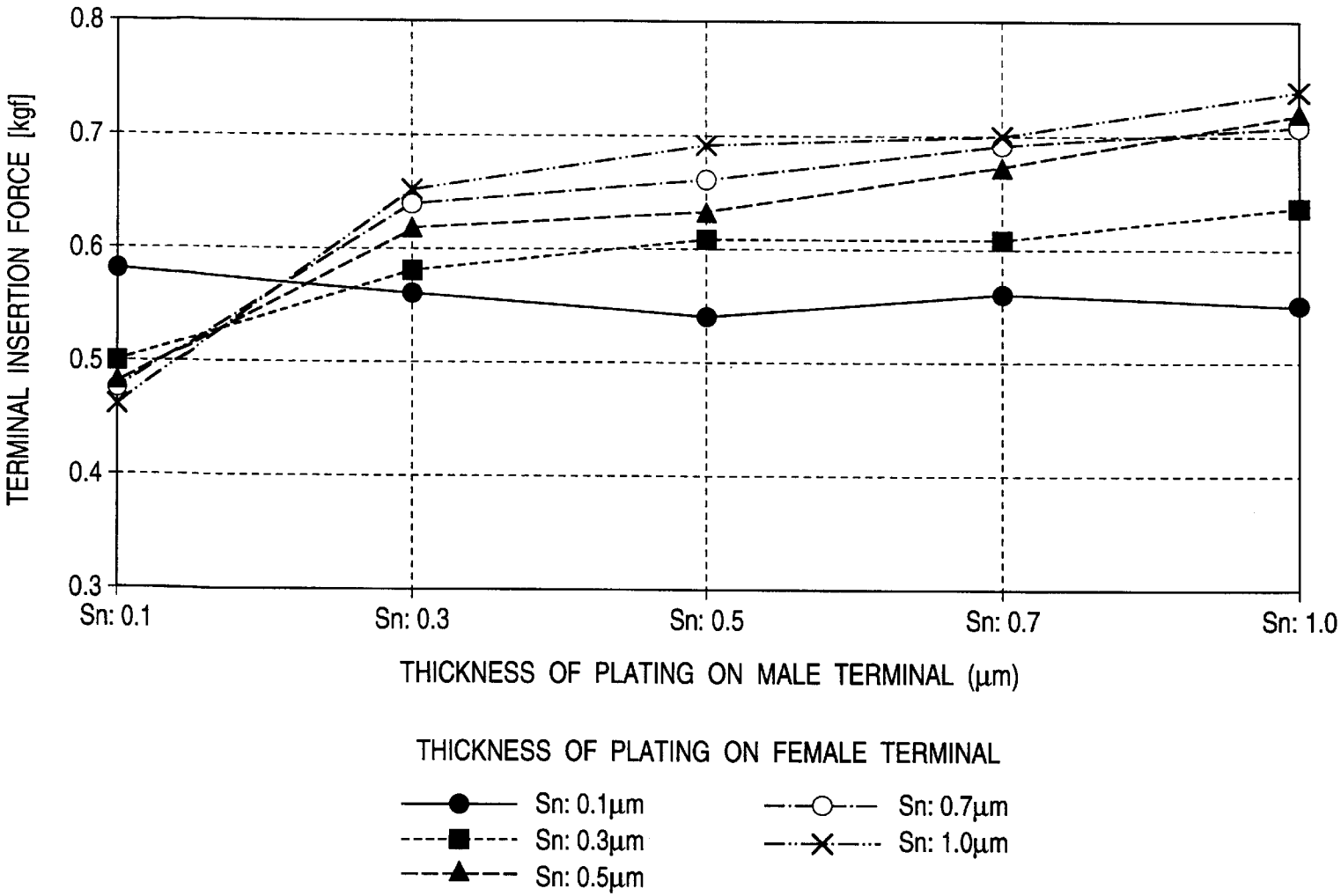
FIG. 3 is a diagram showing test results with respect to an insertion force obtained when reducing the thickness of a tin film on a terminal.

FIG. 3 is a diagram showing the test results of Table 1. When the thickness of a tin film on the conventional terminal is 1.0 $\mu$m, the terminal insertion force is 0.74 kgf. Explanation will be made, using this conventional insertion force as a reference value.

As will be appreciated from the test results, when the thickness of the tin film on one of the male and female terminals 10 and 20 is 0.1 $\mu$m to 0.3 $\mu$m while the thickness of the tin film on the other terminal is not less than 0.1 $\mu$m, the insertion force can be reduced at least by more than 10% as compared with the reference value (that is, the insertion force can be reduced to not more than 0.67 kgf). With the decrease of the thickness of the tin film, the hardness of the terminal is increasingly influenced by the hardness of the base material (of copper or copper alloy), so that the apparent hardness of the terminal increases. When the apparent hardness of the terminal increases, the adhesion of the tin film is suppressed, so that the insertion force is reduced.

The tin film functions also as a lubricant for the sliding-contact portions, and when the thickness of the tin film on each of the male and female terminals 10 and 20 is 0.1 $\mu$m, the tin film loses the function of a lubricant, so that the insertion force somewhat increases with the friction of the base material.

When the thickness of the tin film on the male terminal 10 is 0.1 $\mu$m while the thickness of the tin film on the female terminal 20 is 0.3 $\mu$m to 1.0 $\mu$m, the insertion force is reduced by more than 30% as compared with the reference value (that is, the insertion force is reduced to not more than 0.52 kgf). This indicates that when the thickness of the tin film, formed on that terminal having the larger area of the sliding-contact portions, is reduced, the effect of reducing the insertion force is greater.

If the terminal insertion force is reduced to 0.46 kgf, for example, a force (about 22 kgf (0.74×30)), heretofore required for connecting a 30-pole connector, is reduced to about 14 kgf (0.46×30).

In addition to the low insertion force, a stable, low contact resistance and a good corrosion resistance are required for the connection terminal. The contact resistance is the property which is naturally required for the terminal in so far as the terminal is used for connecting electric wires, and since the corrosion of copper and copper alloy (constituting the base material of the terminal) proceeds particularly in an atmosphere of sulfurous acid gas, the corrosion resistance is also required for the terminal.

Figure 4:
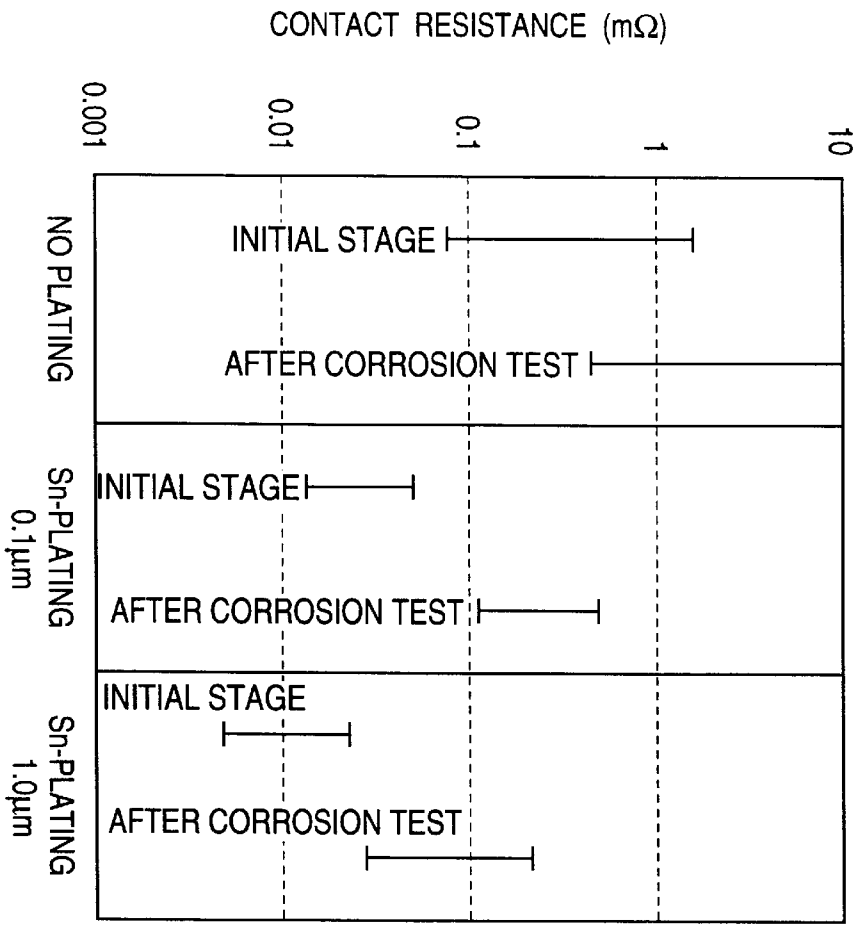
FIG. 4 is a diagram showing a contact resistance and a corrosion resistance obtained when reducing the thickness of a tin film on a terminal.

FIG. 4 is a diagram showing a contact resistance and a corrosion resistance obtained when reducing the thickness of a tin film on a terminal. This diagram shows the contact resistance of the terminal immediately after the terminal was tinned, and also shows the contact resistance of the terminal after the corrosion test was further effected after the terminal was tinned.

As is clear from this diagram, the terminal, having the tin film with a thickness of 0.1 μm, is slightly higher in contact resistance than the terminal having the tin film with a thickness of 1.0 μm, but is sufficiently lower in contact resistance than the terminal having no tin film. Namely, if the thickness of the tin film is not less than 0.1 μm, the low contact resistance can be obtained stably. The contact resistance, required for the connection terminal, is usually not more than 1.0 milli-ohms, and the terminal, having the tin film with a thickness of 0.1 μm, sufficiently meets this requirement.

With respect to the contact resistance after the corrosion test, the terminal, having the tin film with a thickness of 0.1 μm, is slightly higher in contact resistance than the terminal having the tin film with a thickness of 1.0 μm, but is sufficiently lower in contact resistance than the terminal having no tin film. The contact resistance of the terminal, having the tin film with a thickness of 0.1 μm, after the corrosion test is not more than 1.0 milli-ohms, and is less than an allowable value required for the connection terminal.

The tin film can not always be formed uniformly, and when tinning is applied to form a tin film having a thickness of not more than 0.1 μm, part of the base material are not coated with this tin film. In this case, a local cell is formed between the base material (of copper or copper alloy) or the primary coat (of nickel) and the tin, so that electrical corrosion properties are markedly degraded. Therefore, from the viewpoint of corrosion, the tin film, having a thickness of at least 0.1 μm, need to be formed by plating.

Summarizing the foregoing, if the thickness of the tin film on one of the male and female terminals 10 and 20 is 0.1 μm to 0.3 μm while the thickness of the tin film on the other terminal is not less than 0.1 μm, the insertion force can be reduced by more than 10%, and particularly if the thickness of the tin film on the male terminal 10 is 0.1 μm while the thickness of the tin film on the female terminal 20 is 0.3 μm to 1.0 μm, the insertion force can be reduced by more than 30%.

On the other hand, from the viewpoint of the corrosion resistance and the contact resistance, the tin film, having a thickness of at least 0.1 μm, need to be formed by plating. This limitation overlaps the above numerical range concerning the reduction of the insertion force.

C: Nickel (Primary Coat) plating

As described above, in this embodiment, nickel is plated as a primary coat on the surface of the base material (copper), and then tin is plated on this nickel film. The reason why nickel need to be plated will be described with reference to FIG. 5.

Figure 5:
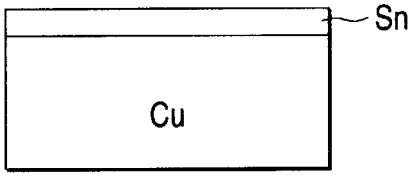
FIGS. 5(*a*) to (*c*) are views explanatory of a nickel film serving as a primary coat.
Figure 5:
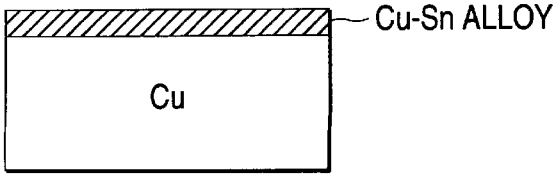
Figure 5:
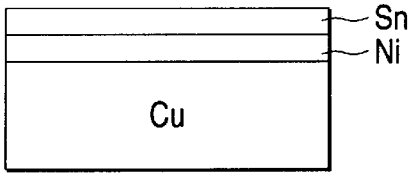

When tinning is applied directly to the surface of the base material (copper) as shown in FIG. 5(*a*), an alloy of copper and tin is formed since copper diffuses into tin even at ordinary temperature. Here, if the tin film is thin as in the above embodiment, this tin film is all formed into an alloy in a relatively short time as shown in FIG. 5(*b*). The thus formed alloy is an intermetallic compound ($Cu_6Sn_5$) composed of copper and tin, and therefore its hardness is very high. Therefore, when the tin film or layer is all converted into the alloy, it is difficult to obtain a low contact resistance when fitting the terminal.

Therefore, when nickel is plated to form the primary coat for the tin film, the tin film will not be formed into an alloy since a coefficient of diffusion of nickel into tin is much lower than a coefficient of diffusion of copper into tin, and therefore the low contact resistance can be obtained stably. In other words, the nickel film, serving as the primary coat, functions as a diffusion barrier layer for copper.

The diffusion barrier layer is not limited to the nickel film, but may be a layer of any other suitable material in so far as it will not diffuse into tin, and one example is titanium nitride.

Although the above embodiment of the invention has been described, this invention is not limited to the above embodiment. For example, a metallic material (higher in hardness than the tin film) other than copper and copper alloy can be used as the base material of the terminal, and examples thereof include aluminum, aluminum alloy, iron alloy, stainless steel and nickel alloy.

In the above embodiment, although the area of the sliding-contact portions of the male terminal 10 is larger than the area of the sliding-contact portions of the female terminal 20, this may be reversed. Namely, convex portions may be formed on the tab 12 of the male terminal 10 while sliding surfaces may be formed at the fitting portion 25 of the female terminal 20.

In the above embodiment, although the thin films are formed by plating on the contact portions of the male and female terminals 10 and 20, the thicker tin film may be formed by partial plating on the wire barrels 11 and 24 each of which is the clamping portion for clamping the wire. The reason is that the clamping portion for clamping the wire is not required to have any properties concerning the insertion force, and need only to provide a stable contact resistance.

As described above, in the invention of claim 1, the tin film, having a thickness of 0.1 μm to 0.3 μm, is formed by plating on the sliding-contact portions of the base material of one of the male and female members while the tin film, having a thickness of not less than 0.1 μm, is formed by plating on the sliding-contact portions of the base material of the other member, the sliding-contact portions of the base material of the one member being in sliding contact with the sliding-contact portions of the base material of the other member during the fitting operation. With this construction, the apparent hardness of the connection terminal increases, so that the adhesion of the tin film is suppressed, and the terminal insertion force can be reduced by more than 10%.

In the invention of claim 2, the tin film, having a thickness of 0.1 μm, is formed on one of the male and female members whose sliding-contact portions are larger in area than the sliding-contact portions of the other member, while the tin film, having a thickness of 0.3 μm to 1.0 μm, is formed on the other member having the sliding-contact portions of a smaller area. With this construction, the adhesion of the tin film is more effectively suppressed, and the terminal insertion force can be reduced by more than 30%.

In the invention of claim 3 and claim 4, the diffusion barrier layer is interposed between the base material of each of the male and female members and the tin film, and therefore the formation of the tin film into an alloy by diffusion of the base material is suppressed, so that the low contact resistance can be obtained stably.

What is claimed is:

1. A fitting-type connection terminal for achieving electrical contact by fitting a male member and a female member together, wherein a sliding-contact portion of a base material of one of the male and female members is plated by a tin film having a thickness of 0.1 μm to 0.3 μm, and a sliding-contact portion of a base material of the other member is plated by a tin film having a thickness of not less than 0.1 μm.

2. A fitting-type connection terminal according to claim 1, wherein a tin film having a thickness of 0.1 μm to 0.3 μm is formed on a larger sliding-contact portion in area of the sliding-contact portions of the male and female members, and a tin film having a thickness of 0.3 μm to 1.0 μm is formed on a smaller sliding-contact portion in area of the sliding-contact portions.

3. A fitting-type connection terminal according to claim 1, wherein a tin film having a thickness of 0.1 μm is formed on a larger sliding-contact portion in area of the sliding-contact portions of the male and female members, and a tin film having a thickness of 0.3 μm to 1.0 μm is formed on a smaller sliding-contact portion in area of the sliding-contact portions.

4. A fitting-type connection terminal according to claim 1, wherein the sliding-contact portion of the base material of the other member is plated by a tin film having a thickness of 0.1 μm to 1.0 μm.

5. A fitting-type connection terminal according to claim 1, wherein a diffusion barrier layer is interposed between the base material and the tin film in each of the male and female members.

6. A fitting-type connection terminal according to claim 2, wherein a diffusion barrier layer is interposed between the base material and the tin film in each of the male and female members.

7. A fitting-type connection terminal according to claim 5, wherein the diffusion barrier layer is a nickel film formed by plating.

8. A fitting-type connection terminal according to claim 6, wherein the diffusion barrier layer is a nickel film formed by plating.

* * * * *